United States Patent [19]

Gladwin

[11] 3,964,727

[45] June 22, 1976

[54] ADJUSTABLE WIDTH CONTINUOUS CASTING MOLD

[76] Inventor: Floyd R. Gladwin, 21000 E. River Road, Grosse Ile, Mich. 48138

[22] Filed: June 30, 1975

[21] Appl. No.: 591,531

[52] U.S. Cl. ..... 249/158; 164/280

[51] Int. Cl.[2] ..... B22D 19/00; B28B 7/02

[58] Field of Search ..... 249/158, 161, 162, 165, 249/167, 169, 155, 160, 163; 164/273 R, 280, 384, 390

[56] References Cited

UNITED STATES PATENTS

| | | | |
|---|---|---|---|
| 1,207,698 | 12/1916 | Attebury | 249/188 X |
| 3,228,071 | 1/1966 | Schultz | 164/280 |
| 3,292,216 | 12/1966 | Colombo | 249/158 X |
| 3,913,658 | 10/1975 | Schmid | 164/280 |

*Primary Examiner*—Francis S. Husar
*Assistant Examiner*—John S. Brown
*Attorney, Agent, or Firm*—Cullen, Settle, Sloman & Cantor

[57] ABSTRACT

A continuous casting mold formed of a pair of spaced mold plate members having mold side members arranged between and a distance inwardly of their side edges to form an open-ended mold cavity for continuously casting metal therethrough. Bolts located between the side members and plate edges extend transversely through both mold plate members to loosely hold them together and springs arranged between the bolt ends and plate members resiliently and tightly hold the plate members towards each other and against the mold side members. The bolts are journalled through transverse openings formed in a mounting block which is connected to the adjacent side member by adjustable length connector members. Oppositely extending pressure applying plungers mounted in the mounting block extend against their adjacent plate member for spreading the plate members apart against the spring resistance and thereby permitting movement of the side members inwardly or outwardly relative to the mold cavity for adjusting the width thereof by manually adjusting the connector lengths.

7 Claims, 7 Drawing Figures

ADJUSTABLE WIDTH CONTINUOUS CASTING MOLD

BACKGROUND OF INVENTION

In the continuous casting of steel, a long, tube-like mold is used for pouring the moten steel into the upper end and permitting the steel to solidify as it passes through the tube-like mold. Thus, molten metal is poured into the upper end of the tube-like mold and at the exit end, solidified metal is removed on a continuous basis.

Such molds are formed of box-like mold sections which are open-ended and which are arranged end-to-end. Each section provides a roughly rectangular-shaped cavity or passageway through which the metal moves. Each section is also usually provided with cooling tubes or passageways through the walls thereof for removing heat from the metal to induce solidification thereof.

In many of these types of molds, the mold is gradually bent from vertical to horizontal so that the molten metal is gravity poured downwardly into the mold, but the solidifed metal exits in a generally horizontal direction.

The sizes of these molds vary but they are of considerable size, as for example, a mold cavity may be on the order of roughly three to eight feet, more or less, in length and on the order of roughly four inches to fourteen inches, more or less, in width. However, these dimensions are illustrative only, as the cavity sizes may vary depending upon the size of the finished product required.

In the conventional construction, each mold section is normally formed of a pair of parallel main or primary plate-like members, each having an inner facing or lining, such as of copper material, against which the metal may contact. The opposite edges between the primary plate-like mold members are closed off with narrow side mold members to complete the roughly rectangular shape of the cavity. Usually, these side members are held in place by bolts so that they are tightly clamped between the primary mold members.

In use of such continuous casting molds in a steel mill, from time to time, it is necessary to adjust, i.e., change, the width of the mold cavity to provide finished solidified metal of predetermined width. For example, at one time it may be desired to run on a width of 3 feet and at another time 3½ feet, etc. Hence, to adjust the width of the conventional molds, it is necessary to shut down the continuous casting operation and then to manually relocate or move the side mold section members inwardly or outwardly relative to the mold cavity, to provide the desired width. This requires some considerable time both to permit sufficient cooling of the mold sections for manually working on them for adjusting the location of the side mold members, as well as considerable labor and effort.

Thus, the invention herein relates to an improvement in such continuous casting mold sections wherein the mold side members may be rapidly adjusted inwardly or outwardly relative to the cavity, with minimal time needed for stopping the continuous casting operation and with minimal labor and time.

SUMMARY OF INVENTION

The invention herein contemplates providing width adjustability of an open-ended continuous casting mold formed of parallel plate-like mold members closed at their ends with side members by connecting the side members through adjustable length connectors to mounting blocks which are supported upon bolts which hold the mold members together and, by spring means, clamp the side members between the mold members. Pressure members mounted in the block permit spreading the mold members apart against the spring resistance for adjusting, inwardly or outwardly, the end member locations when desired. The end members are otherwise free of connection to the mold members to facilitate movement thereof upon loosening the clamping action of the bolt-spring holders.

The pressure means are easily and rapidly operable to sufficiently spread apart the mold members for rapid adjustment of the end members when desired, without requiring a shut-down of the complete continuous casting operation. Upon release of the pressure means, the mold plate members, due to the spring pressure, return to normal position, that is, gripping or clamping the side members between them to form the box-like casting cavity.

The block construction is such that it may be added to existing casting molds with relatively simple modifications of the mold so that it can convert conventional continuous casting molds into adjustable width molds of the type herein.

These and other objects and advantages of this invention will become apparent upon reading the following description, of which the attached drawings form a part.

DETAILED DESCRIPTION

Figure 1:
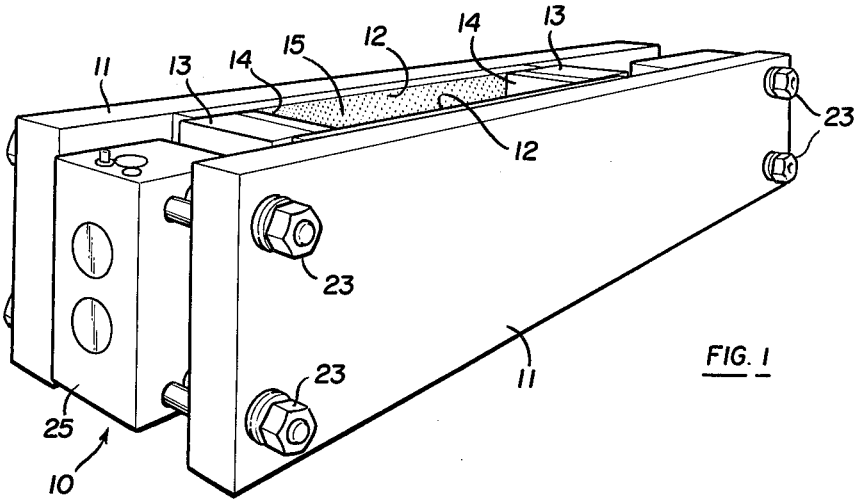
FIG. 1 is a perspective view of a continuous casting mold section incorporating the adjustable mold side members herein.
Figure 2:
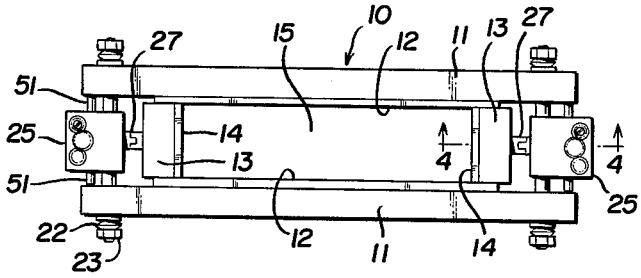
FIG. 2 is an enlarged top plan view of the mold section.
Figure 3:
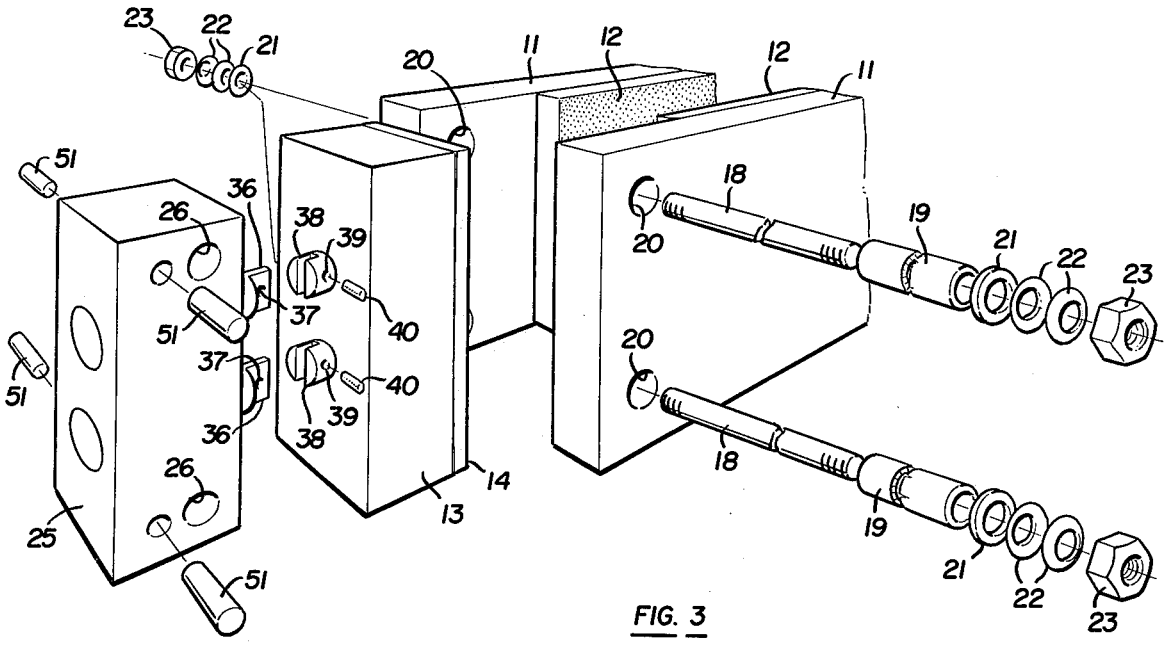
FIG. 3 is an enlarged, fragmentary, perspective view of one side of the mold section with the parts disassembled.

FIGS. 1 and 2 illustrate a continuous casting mold section 10 of the type used in continuously casting molten steel. Such sections are arranged end to end to form a continuous, roughly rectangular in cross-section, mold cavity into which molten steel is poured and through which the steel passes, is cooled and solidified for continuous withdrawal. Such mold sections as are used in a continuous casting mold are all essentially the same except in many cases, the interiors are curved to some degree for gradually curving the downwardly moving steel into a horizontal direction. For purposes of illustration, the various curvatures and mold construction details which are conventional, are omitted.

The mold section basically consists of a pair of main or primary mold plate-like members 11, each having a mold facing or lining 12, such as of copper, which is suitably machined to provide required dimensions and curvatures. The mold sections also include a pair of opposite side mold members 13, each having a lining or facing 14, similar to that of the mold members, with the side mold members clamped or held between the primary mold members. Thus, the primary and side mold members together form an open ended, i.e., upper and lower open ends, roughly rectangular in cross-sectional shaped passageway or casting cavity. In the improvement herein, the mold side members are arranged a distance inwardly of the vertical edges of the primary mold members.

Bolts or threaded ended shafts 18 encircled by sleeves 19 extend through aligned openings 20 in the primary mold members. The opposite ends of the bolts or shafts are provided with washers 21, opposed cup or dished spring washer members 22 arranged face to face to form a V in cross-section annular spring, and nuts 23. The bolts or shafts themselves, loosely connect together the primary mold members. The spring washers apply a spring force which tightly clamps the side members between the primary mold members and prevents separation thereof under the hydrostatic pressures of the molten metal.

Figure 4:
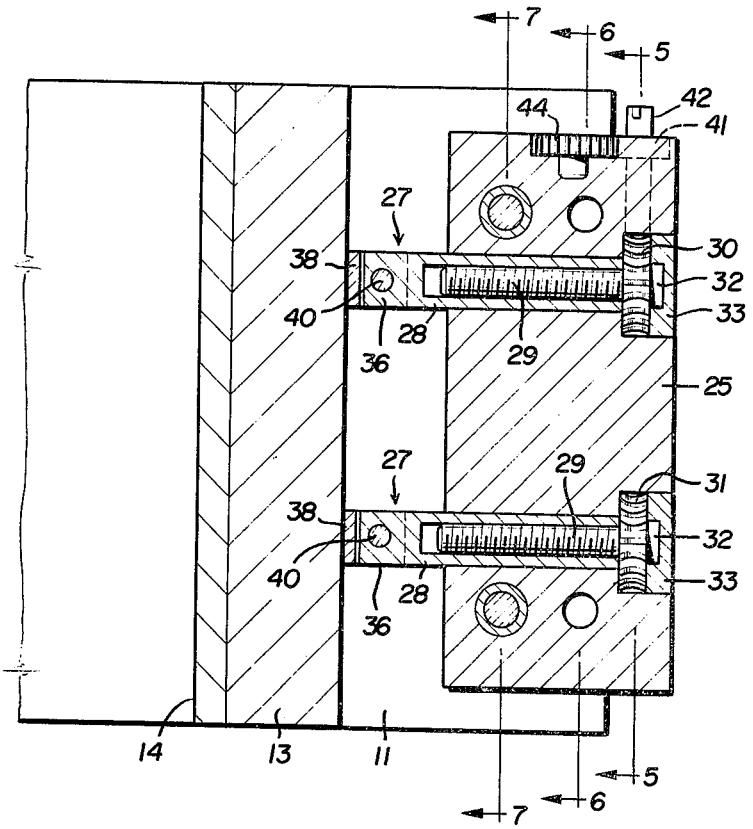
FIG. 4 is an enlarged, partially cross-sectioned, elevational view taken in the direction of arrows 4—4 of FIG. 2.
Figure 5:
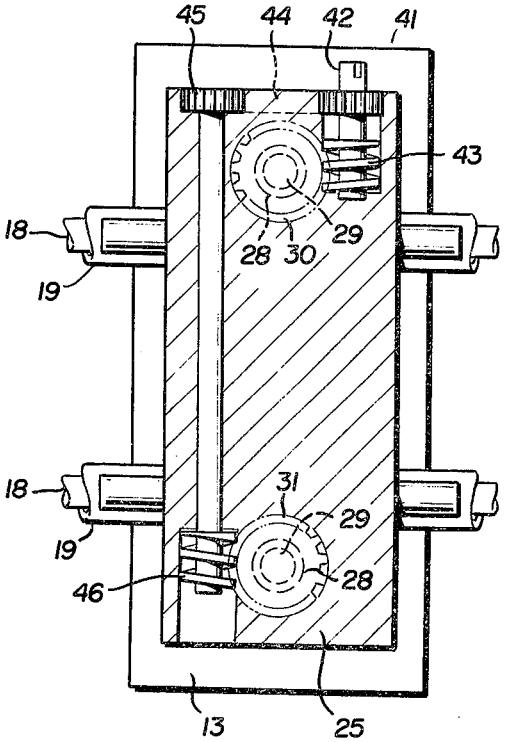
FIG. 5 is a cross-sectional view taken in the direction of arrows 5—5 of FIG. 4.

At each opposite end of the mold, mounting blocks 25 having transverse openings 26 are mounted upon the sleeve-bolts which are journalled through such openings so that the blocks may shift upon the sleeve-bolts for centering. The sleeve-bolts also resist or eliminate mold part sagging when the axial pressure of spring washer members 22 is released. Each block is connected to its adjacent mold side member by means of adjustable length connectors 27. As illustrated in FIG. 4, such connectors are formed of internally threaded tubes 28 within which are engaged screws 29. One of such screws is connected to an upper gear 30 and the other lower screw, is connected to a lower gear 31. Each of the gears have gear hubs 32 for holding and rotating them within socketed gear holding caps 33 fitted into corresponding openings in the faces of the mounting blocks.

Each of said tubes extend inwardly of the mold and their inner ends are flattened at 36 and provided with an opening 37. The flattened ends fit within U-shaped yokes or brackets 38 secured, as by welding, to the mold side members. The brackets are provided with aligned holes 39 to receive pivot pins 40 for pivotally interconnecting the tubes to the brackets and thus, to the side member.

A drive gear 41 is mounted on the upper end of each block and is provided with a wrench stud 43 for engagement by a manually operated wrench or crank for rotation thereof. Such gear is connected to a threaded shaft 43 which extends downwardly through a corresponding opening in the mounting block, to engage the upper gear 30. In addition, a removable idler gear 44 is mounted at the upper end of the block and engages a secondary gear 45 connected to a second threaded shaft 46 extending downwardly through a corresponding opening in the mounting block for engaging the lower gear 31.

Rotation of the wrench stud causes rotation of the drive gear 41, the secondary gear 45, through the idler gear 44, and correspondingly, the threaded shafts 43 and 46. These then rotate the gears 30 and 31 to rotate the screws 29 within the threaded tubes 28 for thereby moving the tubes either towards or away from the interior of the mold, i.e., for expanding or contracting the lengths of the connectors.

The idler gear may be removed from tooth contact by pulling it upwardly and outwardly so that the secondary gear 45 may be operated independently by a suitable wrench for thereby moving one of the connectors more than he other, to thereby angularly tip the side member should such angularity be desired for casting purposes.

Figure 6:
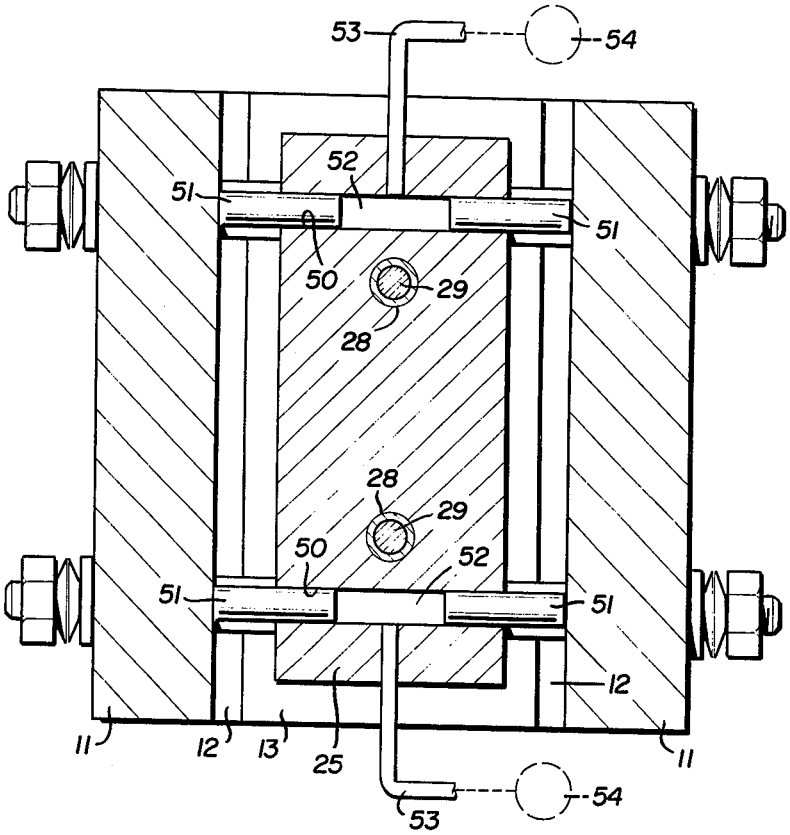
FIG. 6 is a cross-sectional view taken in the direction of arrows 6—6 of FIG. 4.
Figure 7:
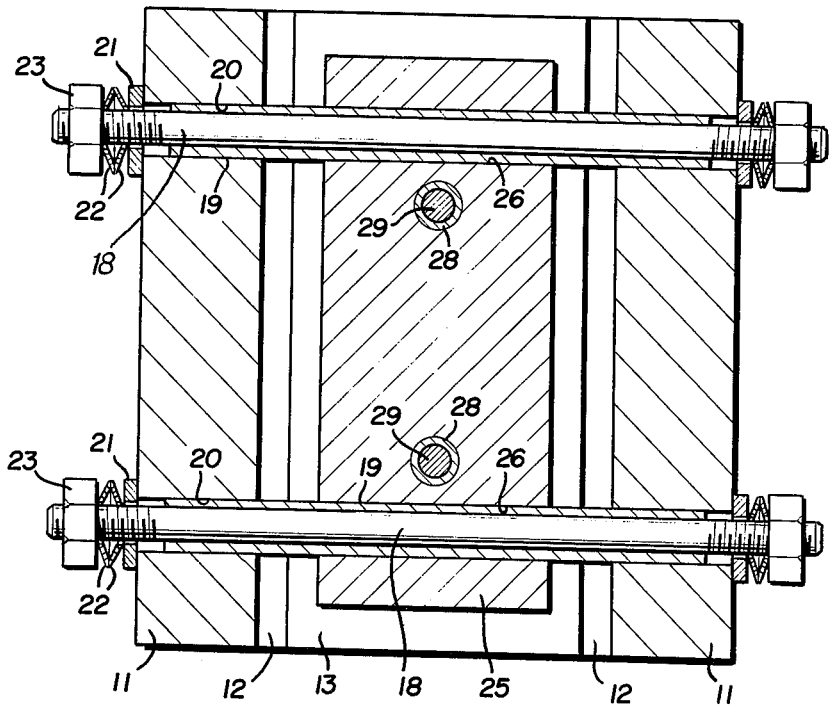
FIG. 7 is a cross-sectional view taken in the direction of arrows 7—7 of FIG. 4.

The mounting blocks each include transverse bores 50, each containing a pair of plungers or pressure members 51 extending transversely outwardly therefrom to provide a pressure chamber or space 52 within the bore between the pressure members. As illustrated schematically in FIG. 6, hydraulic lines 53 communicate with each of such pressure chambers and these in turn connect to manually actuable hydraulic pump-motor mechanisms 54 which are of a conventional type. Thus, operation of a pump-motor (which is schematically illustrated) causes a pressure build-up between the pressure members and causes them to move outwardly of each other and against the adjacent surfaces of the primary mold members for thereby separating the mold members against the resistance of the springs 22. Conversely, release of the hydraulic pressure permits the pressure members to retract within the bores due to the spring 22 pressure and returns the mold members back to their original positions.

In operation, the side members are positioned between the mold members as illustrated in FIGS. 1 and 2, with the mounting blocks journalled upon the bolts. The spring pressure forces the mold members together to clamp all the parts and maintain the casting cavity. Should it be desired to adjust the width of the cavity, operation of the pressure members, i.e., by applying hydraulic pressurized fluid into the bores, causes the pressure members to separate the primary mold members sufficiently to permit rotation of the drive gear 41 to thereby cause the tubes 28 to move inwardly or outwardly of the mold to shift the side members relative to the mold cavity. Release of the hydraulic pressure then permits the pressure members to retract resulting in reclamping the mold parts together due to the spring pressure. The entire operation can be done very rapidly with little if any interruption of the casting process.

In acutal commercial use, the mold members would normally contain internal passageways or tubing with connections thereto for flowing cold water through the interior of the mold members for carrying away heat from the metal being cast. In addition, depending upon the sizes, additional bolts or shafts may be used, i.e., more than the two illustrated.

Having fully described an operative embodient of this invention, I now claim:

1. Apparatus for adjusting the width of a continuous casting mold formed of a pair of spaced apart, substantially parallel, rigid, plate-like members, forming opposed casting faces, and side members arranged between the mold members at the opposite sides thereof to provide a roughly rectangular shaped, in cross-section, open ended casting cavity for continuous casting of metal therethrough, comprising:

at least one of said side members being located a distance inwardly of the adjacent edges of the mold members, and bolt-like members extending between the mold members, between said one side member and its adjacent mold member side edges, and loosely holding the two mold members together and towards said one side member;

a spring means arranged between the bolt-like members and at least one of the mold members for normally forcing said one mold member towards the other for clamping the mold members against said one side member and for normally resisting separation of the two mold members, but permitting limited separation of the two mold members for releasing th clamping of said one side member against the resistance of said spring means;

a mounting block supported between the mold members and outwardly of said one side member and adjustable length connector members interconnecting said mounting block and said one side member;

pressure members mounted upon said mounting block for engaging and for selectivly exerting a separating pressure upon the mold members for overcoming the force of the spring means and thereby releasing the side member, whereby said one side member may be adjusted inwardly or outwardly of the mold casting cavity for adjusting the width of said casting cavity and said pressure members may be released for reclamping said one side member between the mold members.

2. A construction as defined in claim 1 and said mounting block being formed with transversely extending openings through which said bolt-like members are journalled for supporting and positioning the mounting block.

3. A construction as defined in claim 1 and said pressure members including opposed, transversely extending plungers fitted within receiving openings formed in the mounting block and extending therefrom against said mold members, and means for moving the plungers axially against the mold members for separating them against the spring force.

4. A construction as defined in claim 1 and said connector members including threaded screws having end portions extending into the mounting block and gear means for rotating said screws, and opposite ends engaged within threaded socket portions attached to said one side member for thereby moving the side members inwardly and outwardly of the mold cavity.

5. A construction as defined in claim 1 and said mounting block having openings extending therethrough, with said bolt-like members extending through said openings for journalling the mounting block thereon, whereby said block may shift axially relative to said bolt-like members;

and bores extending through said mounting block parallel to said openings and receiving plungers extending outwardly therefrom for engaging at least one of said mold walls to form said pressure members, and means for axially moving said plungers towards said mold member for separating the mold members.

6. A construction as defined in claim 5 and said bores opening at opposite sides of said mounting block and including plungers extending therefrom from both ends of said bores and means for providing pressurized fluid to the bores between the adjacent ends of the plungers for separating them against the mold members.

7. A construction as defined in claim 6, and including sleeves mounted upon and surrounding said bolt-like members and extending throgh the openings in the mounting block for slidably supporting the mounting block upon the bolt-like members.

* * * * *